US005433158A

United States Patent [19]

Moore, III

[11] Patent Number: 5,433,158

[45] Date of Patent: Jul. 18, 1995

[54] EMBROIDERY HOOP FRAMING JIG WITH EXTENSIONS

[76] Inventor: E. Frank Moore, III, 4447 Old Randleman Rd., Greensboro, N.C. 27406

[21] Appl. No.: 179,344

[22] Filed: Jan. 10, 1994

[51] Int. Cl.[6] ..... D05C 9/04

[52] U.S. Cl. ..... 112/103; 38/102.2

[58] Field of Search ..... 112/78, 103, 121.12, 112/121.15; 38/102, 102.2; 223/38, 44, 61, 84, 120; 269/303

[56] References Cited

U.S. PATENT DOCUMENTS

| | | | |
|---|---|---|---|
| 4,767,111 | 8/1988 | Guenther | 269/303 |
| 4,774,778 | 10/1988 | Williams | 38/102.2 |
| 4,875,268 | 10/1989 | Szarka | 223/120 X |
| 4,981,092 | 1/1991 | Bauman et al. | 112/103 |
| 5,018,460 | 5/1991 | Schilling | 38/102.2 |
| 5,222,314 | 6/1993 | Inteso | 112/103 X |
| 5,263,611 | 11/1993 | Martin | 223/61 X |

FOREIGN PATENT DOCUMENTS 0466269 1/1992 European Pat. Off. ..... 38/102.2

*Primary Examiner*—Clifford D. Crowder
*Assistant Examiner*—Ismael Izaguirre

[57] ABSTRACT

A framing jig is provided to insure accurate., consistent hoop framing of garments such as t-shirts, jackets, pants or other items for subsequent embroidering. The framing jig is especially useful in high production shops which require rapid hoop framing of a large number of similarly sized items. The framing jig includes a removable insert having a plurality of apertures for receiving variously sized exterior embroidery hoops and also includes adjustable side and top base extensions for quick changes to accommodate different size garments. The insert can be removed, rotated and replaced in a matter of seconds in the base for the most accurate and desired framing area possible. In addition, an adjustable collar slide permits the easy centering of the garment on the jig.

6 Claims, 3 Drawing Sheets

EMBROIDERY HOOP FRAMING JIG WITH EXTENSIONS

BACKGROUND OF THE INVENTION

1. Field of the Invention

The invention herein pertains to high production commercial embroidering as is used to place logos or names on shirts as required by businesses and particularly to the continuous hoop framing of such garments before they are loaded on an embroidering machine.

2. Description of the Prior Art and Objectives of the Invention

In recent years the demand for garments having first quality, logos, trademarks and the like has increased as more and more businesses realize the benefits of supplying workers with shirts, jackets and other garments employing company identification. Also, sports fans have become increasingly enthusiastic about purchasing apparel which identifies their team. While printing of identifying markings on various items has not been totally replaced, the demand for sewn or embroidered goods has rapidly multiplied and shop owners which use multiple-head embroidering machines (which may embroider twelve to fifteen garments at a time), which are computer controlled, are now running two to three shifts a day to keep up with demand. Hoop framing, as is conventionally performed in the trade, utilizes a relatively large exterior embroidery hoop which may be placed, for example, inside a t-shirt to provide a selected area upon which the logo or emblem is later embroidered. Once the exterior hoop is so placed, an interior embroidery hoop is then urged from outside the shirt into the exterior hoop, thereby sandwiching a tight circle of cloth therebetween. The so "hooped-framed" garment is then positioned in a hoop holder on an embroidering machine and the logo or emblem is then sewed within the framed circle. After sewing, the framed garment is removed from the machine, the hoops disengaged, and another framed garment is placed on the embroidering machine and the cycle repeated. For multi-head embroidering machines, twelve to fifteen framed garments are simultaneously loaded and embroidered.

While the sewing (or embroidering) is usually completed in rapid fashion and the loading and off-loading of the hoop-framed garments can be quickly, manually carried out, the steps of hoop framing the garment are generally slow and create bottlenecks in the embroidering process. While some mechanical framed presses have been utilized to increase the hoop framing speed, such mechanical devices are lacking in versatility and cannot be easily and quickly varied for different garment sizes.

Thus with the disadvantages and shortcomings of prior hoop framing methods, the present invention was conceived and one of its objectives is to provide a jig and method for embroidery hoop framing which will allow a high volume of particularly sized garments to be rapidly, accurately and consistently hoop-framed.

It is another objective of the present invention to provide an apparatus and a method for hoop framing garments such as shirts which will allow the jig employed to be quickly changed for use from one size garment to another.

It is still another objective of the present invention to provide an embroidery hoop framing jig having an insert which will accommodate various positionings of logos or emblems on a garment and which will accommodate many sizes of embroidery hoops to suit the needs of the user.

It is also another objective of the present invention to provide an embroidery hoop framing jig which is positioned on a stand to provide convenience for the user.

Various other objectives and advantages of the present invention become apparent to skilled in the art as a more detailed description is set forth below.

SUMMARY OF THE INVENTION

The aforesaid and other objectives are realized by providing an embroidery hoop framing jig and method which will allow accurate, consistent hoop framing of garments or other items for embroidering purposes. The framing jig includes a curved stand which is attached to the back of the jig to position it at an approximately eighty degree (80°) angle for stability and convenience to the user. The hoop framing jig includes a base mounted stand and a base insert which can be turned to any of a variety of positions for placement in the base to suit the user's needs. The insert may include a plurality of hoop apertures for various size embroidery hoops and, in addition to being turned, the insert can be reversed for additional versatility during positioning in the base. The apertures in the base are configured to accept conventional exterior embroidery hoops and may, for example, accommodate four different hoop sizes. A tension member on the insert allows a properly sized exterior embroidery hoop to "snap" into the insert and be tightly held in place as the garment is positioned over the jig and the interior embroidery hoop pressed into engagement therewith. Side and top base extensions attached to the base allow the jig to increase in size for larger garments and a collar slide helps insure proper garment positioning. Knobbed threaded members are tightenable to insure that the side and top base extensions are secured in place and can be loosened for quick adjustment of the side and top base extensions. The collar slide likewise has knobs for tightening the slide at a chosen lateral position.

The method utilizing the embroidery hoop framing jig includes positioning the insert in the base with the selected aperture at the desired location. An exterior embroidery hoop is then manually urged into the selected aperture. Next a garment or other item of required size is placed over the hoop framing jig and the top and side base extensions are adjusted to snugly fit within the garment. The collar slide is then adjusted as necessary and lastly, an interior embroidery hoop is urged into the prepositioned exterior embroidery hoop to tightly sandwich a circle of garment material therebetween. The garment is then removed from the hoop framing jig with the embroidery hoop attached and positioned on an embroidering machine for embroidering purposes. Another garment of the same size or dimensions can then be placed on the hoop framing jig without modification to the jig and subsequent garments can be rapidly "hoop framed" and embroidered.

DESCRIPTION OF THE PREFERRED EMBODIMENTS

The preferred form of the apparatus of the invention is presented in FIGS. 1–7 whereby a hoop framing jig is seen having a substantially rectangular base with a depression or cavity for accommodating an insert. The insert is receivable within the base depression in any of four ninety degree (90°) turned positions and can also be reversed (front to back) to increase its positioning versatility. The insert includes tension members along spaced apertures and, in the insert preferred form, four different apertures of various sizes are utilized for maximum convenience. A left side base extension, right side extension and a top base extension are slidably joined to the base to adjust the base for snugly fitting within a selected size garment. Threaded members are tightenable to a back plate to insure that the base extensions stay in the desired position during consecutive garment hoop framing. A collar slide is laterally adjustably tightenable along the upper surface of the top slide. A stand attached to the back plate of the base causes the hoop framing jig to realize an approximately seventy-five degree (75°) angle from the horizon for convenience in use.

The preferred method of the invention comprises positioning the insert in the base with a desired aperture at the required position. An exterior framing hoop is then placed in said desired aperture and a particular size garment is selected and drawn over the hoop framing jig. Next, the left and right base extensions are adjusted along with the top base extension to provide a snug garment fit with the exterior embroidery hoop centered around the area of the garment which is to be embroidered. Next, an interior embroidery hoop is urged with garment fabric into the prepositioned exterior embroidery hoop whereby a circle of fabric is held tightly between the exterior and interior hoops. The garment is next removed from the hoop framing jig with the embroidery hoops attached and the garment is subsequently positioned on an embroidering machine for stitching purposes. Thereafter, another exterior embroidery hoop is positioned in the desired aperture and another garment of the same size is positioned over the hoop framing jig without any modifications or adjustments required. An interior embroidery hoop is then urged with the garment fabric into the prepositioned exterior hoop and the garment is then removed for subsequent embroidering. This process is repeated over and over for as many garments of the same size as is required without adjustment to the jig. Thereafter, the embroidery frame hoop jig can be again adjusted for a different size garment and the process repeated as often as necessary.

DETAILED DESCRIPTION OF THE DRAWINGS AND OPERATION OF THE INVENTION

Figures 1, 4:
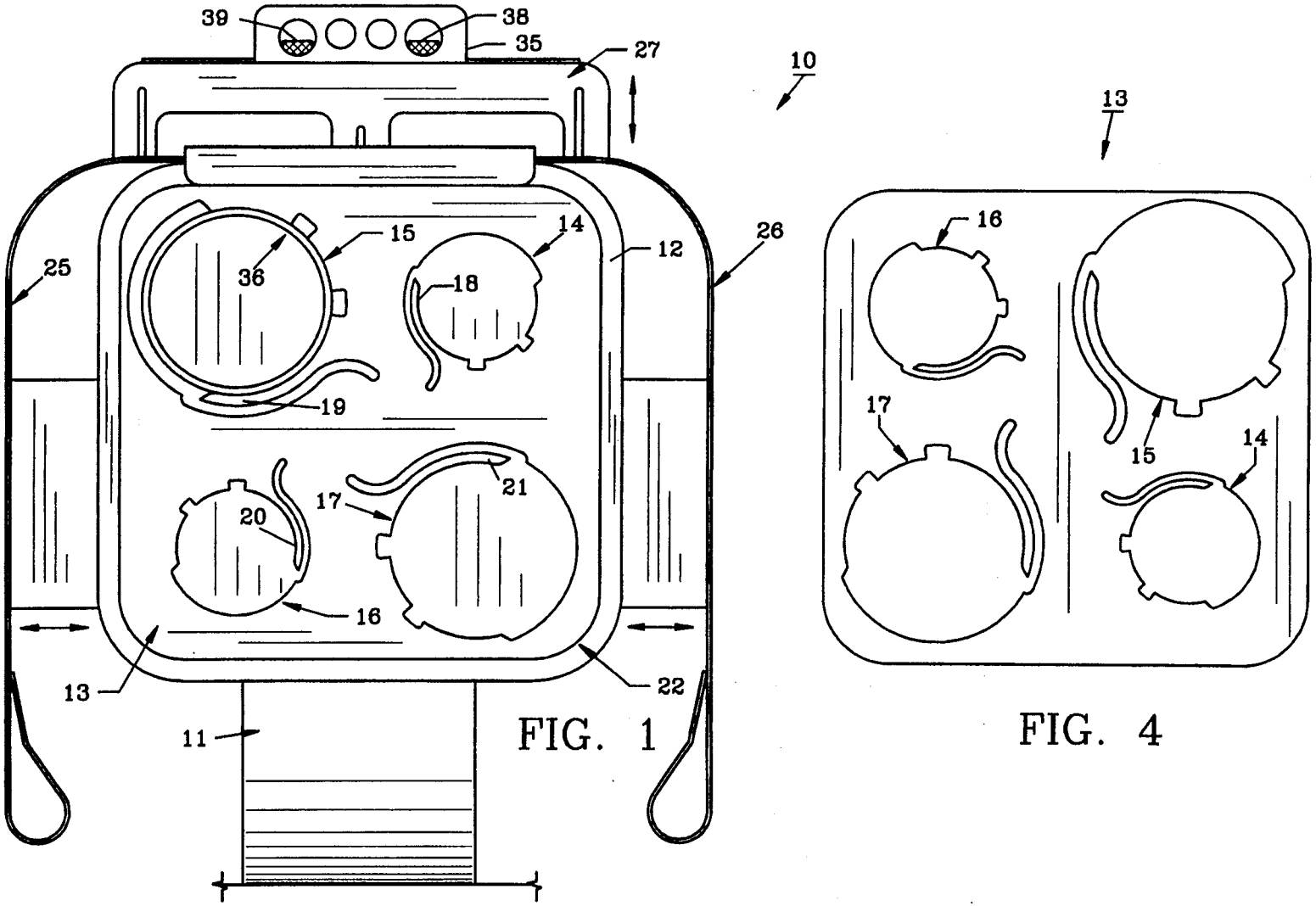
FIG. 1 shows a front view of an embroidery hoop framing jig of the invention with the left side, right side and top base extensions slightly spaced from the base.
FIG. 4 shows a view of the base insert as shown in FIG. 1 which has been rotated ninety degrees (90°)

For a more complete understanding of the invention and its method of operation, turning now to the drawings, FIG. 1 shows a front view of an embroidery hoop framing jig 10 positioned on stand 11 which includes a substantially rectangular base 12 with insert 13 positioned therein. As seen in FIG. 4, base insert 13 is likewise somewhat rectangularly shaped and includes a plurality of apertures 14, 15, 16 and 17, each for receiving an exterior embroidering hoop. Apertures 14, 15, 16 and 17 are shown with various diameters for accepting and surrounding various size embroidery hoops although such apertures may be the same size if desired, or all different sizes.

Base insert 13 is formed from a one-half inch composite material to provide a light yet durable insert. Base 12 may be aproximately one inch (1") (2.54 cm) thick with a one-half inch (0.5") (1.27 cm) depression 22. Tension members 18, 19, 20 and 21 provide tension for an exterior embroidery hoop of a hoop set as may be positioned within respectively apertures 14–17. Insert 13 as seen in FIG. 4 can be rotated to four ninety degree (90°) positions to accommodate a particular hoop size and placement. As shown, insert 13 has four hoop apertures therein but any number and positioning of apertures may be utilized.

Figure 2:
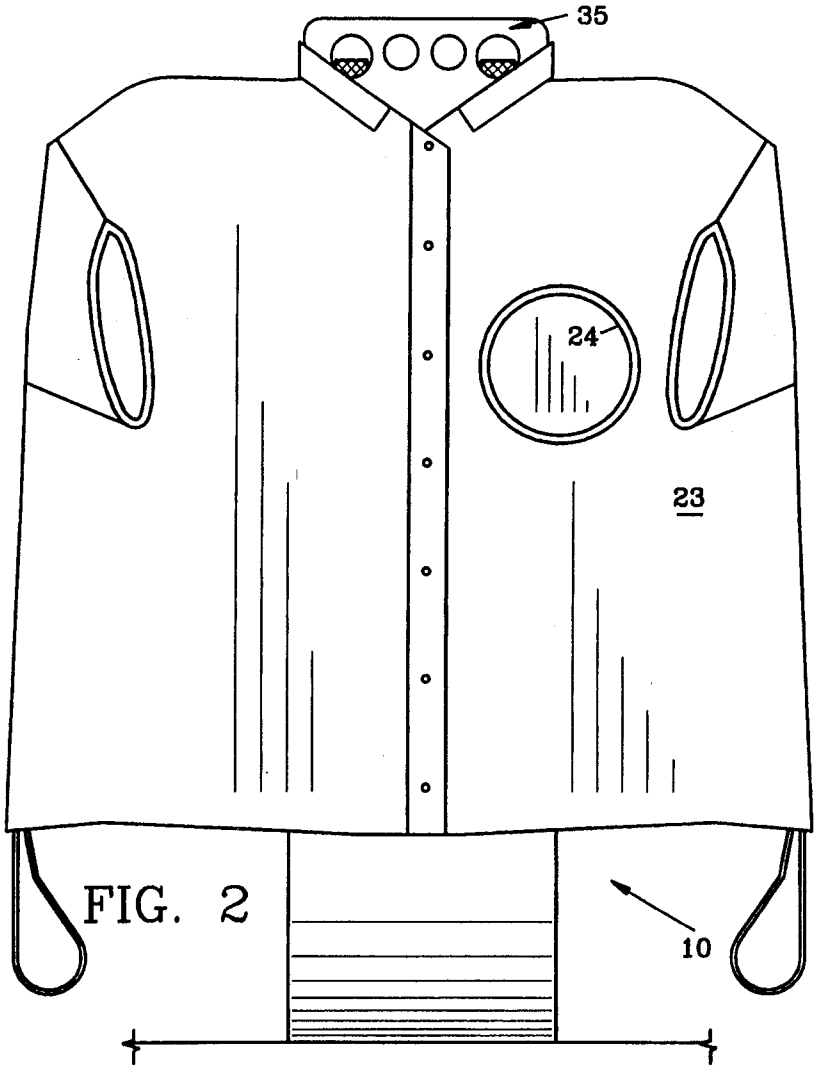
FIG. 2 demonstrates a view of the framing jig as shown in FIG. 1 with a shirt positioned thereon which has been hoop framed for embroidering purposes.

In FIG. 2, shirt 23 is in position on hoop framing jig 10 with interior embroidery hoop 24 in place. Interior hoop 24, as understood by those skilled in the art defines an area on the front of a shirt which is "framed" by a circular section of garment cloth between an exterior embroidery hoop (not seen) (inside shirt 23) and interior embroidery hoop 24.

Figure 7:
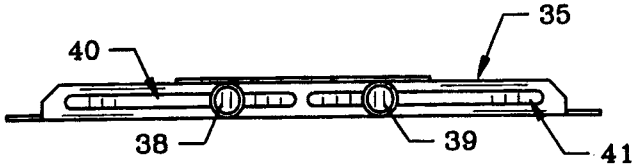
FIG. 7 demonstrates a top plan view of the collar slide along line 7—7 of FIG. 6.
Figure 6:
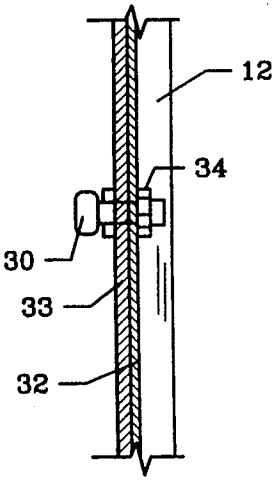
FIG. 6 pictures a cross-sectional view along lines 6—6 of FIG. 5.
Figure 5:
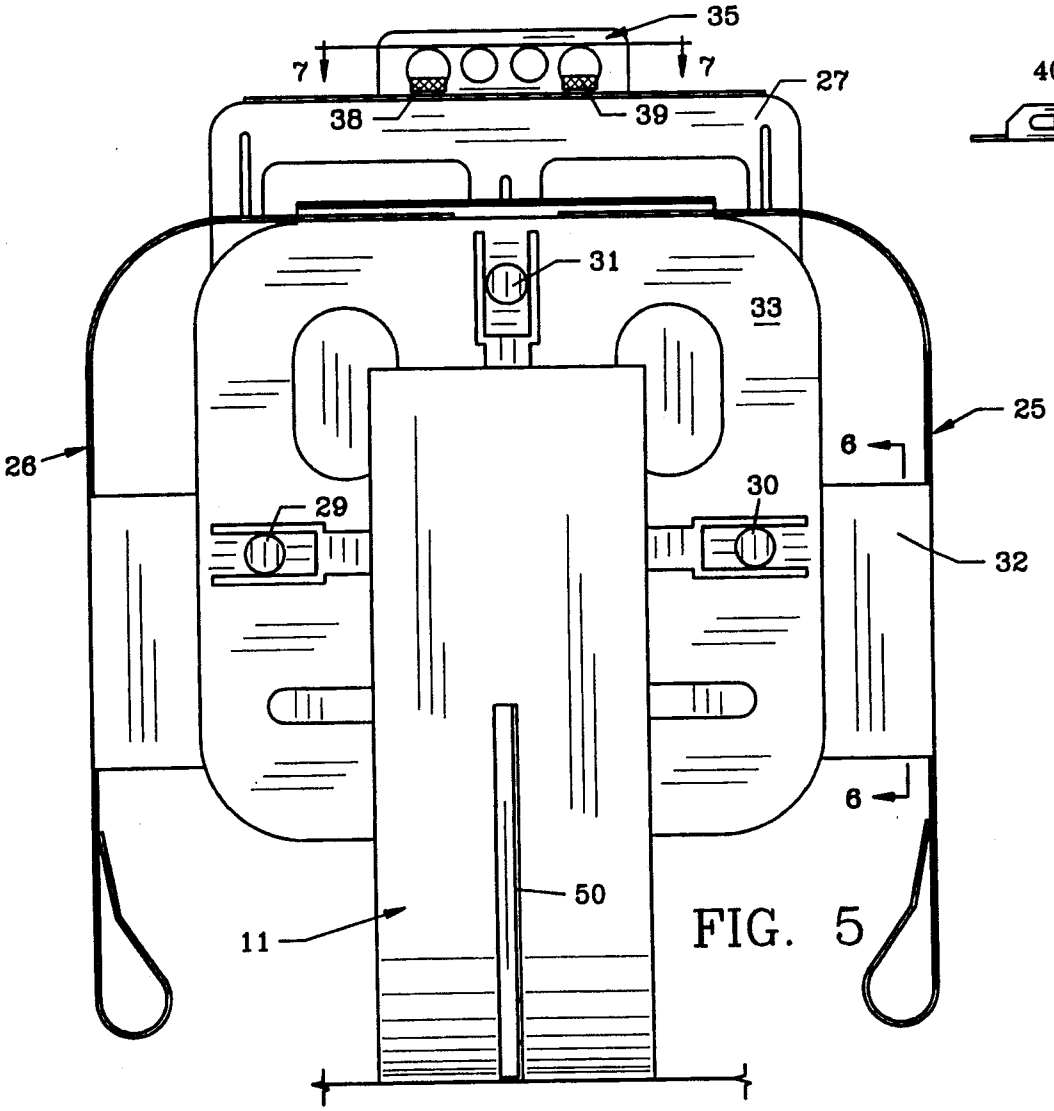
FIG. 5 depicts the hoop framing jig as shown in FIG. 1 from a rear elevational view.

As further illustrated in FIG. 1, hoop framing jig 10 includes left side base extension 25 and a right side base extension 26 slidably joined to base 12 to adjust to the particular width of a selected t-shirt or other garment to hold the garment is a relatively tight posture as seen in FIG. 2. Top base extension 27 is also shown in FIG. 1 which will provide additional height in the event a shirt is used which is longer than base 12. Top base extension 27, right side base extension 26 and left side base extension 25 are secured in place by threaded members 31, 29 and 30 respectively as seen in FIG. 5. FIG. 6 demonstrates a close-up view along lines 6—6 of FIG. 5 of left side base extension plate 32 which is slidably positioned between back plate 33 and hoop framing base 12. As shown, threaded member 30 is tightable into nut 34 (within base 12) and when threaded member 30 is tightened, prevents left side base extension 25 from moving. The same type of means is used for right side extension 26 and top base extension 27. In FIG. 7 a top view of collar slide 35 is shown with threaded members 38, 39 positioned in slots 40, 41 respectively. Collar slide 35 is moved laterally as needed depending on the particular shirt and/or mounting desired on jig 10.

Figure 3:
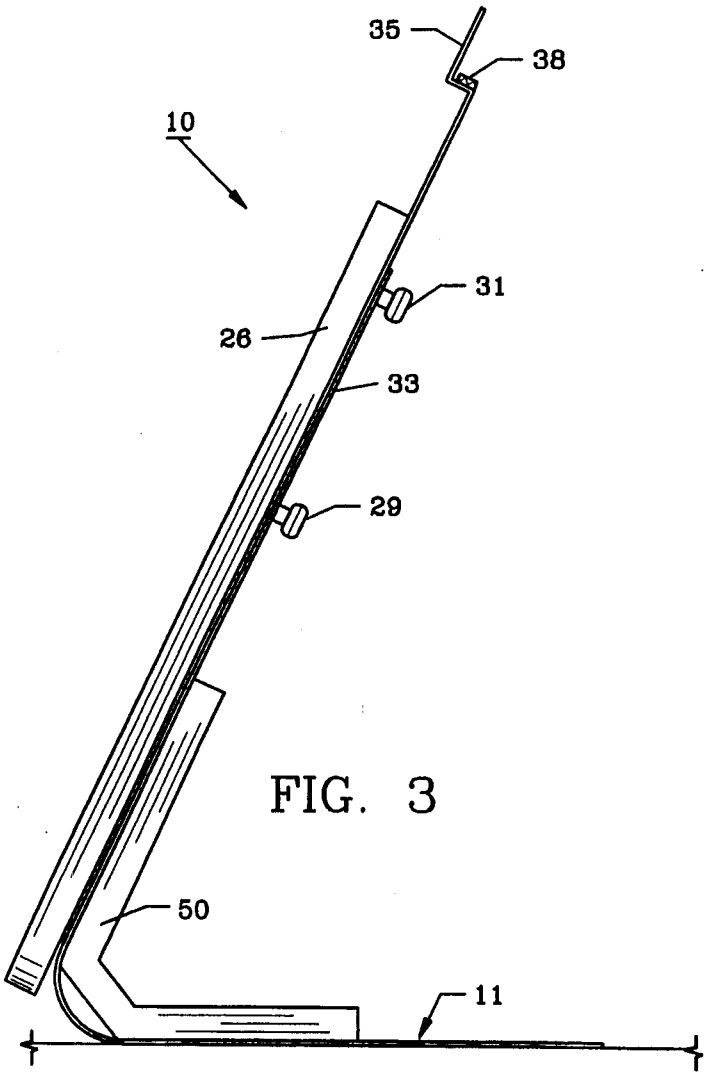
FIG. 3 illustrates a side elevational view of the hoop framing jig as shown in FIG. 1.

As shown in FIG. 3, stand 11 allows jig 10 to be positioned at an approximately seventy-five degree (75°) angle and includes a stiffening brace 50. Brace 50 may be made of one inch (1") angle iron to provide rigidity and durability for stand 11.

The method of hoop framing employing jig 10 as shown in FIGS. 1–7 includes selectively positioning base insert 13 into depression 22 within base 12. Base insert 13 is so placed to provide the proper size and position of one or more apertures 14, 15, 16 or 17 as hereinbefore described. With base insert 13 so positioned, exterior framing hoop 36 as shown in FIG. 1 is positioned within aperture 15. Next, a shirt such as 23 shown in FIG. 2 is positioned over collar slide 35 and is urged downwardly along its full length to cover base insert 13. Next, right side base extension 26 and left side base extension 25 are released by threaded members 29, 30 respectively and are tightened as is top base extension 27 whereby shirt 23 is taut on jig 10. Next, an interior embroidery hoop such as 24 as shown in FIG. 2 is then pressed into exterior framing hoop 36 with fabric therebetween. Once shirt 23 is so framed, shirt 23 is then pulled upwardly from jig 10 with the interior and exterior framing hoops in place. The hoop-framed shirt can then be positioned on an embroidering machine and the stitching completed. In the meantime, during the embroidering process, another exterior embroidery hoop can be positioned in aperture 15, and another shirt of the same size positioned on jig 10 without adjusting the side or top base extensions and another interior framing hoop inserted to form a tight fabric circle whereupon the process can be repeated over and over without having to make adjustments for the overall jig size. As smaller or larger shirts are thereafter required, the proper positioning of insert 13 can be established, top base extension 27 and side base extensions 25, 26 adjusted and the hoop-framing process repeated. As shown, once jig 10 is properly adjusted, shirts of the same size can be hoop-framed continuously with minimal effort.

As would be understood, shirts are used herein for explanatory purposes and various other garments and items can be employed utilizing jig 10 to save time and effort in the hoop framing process. Also, greater consistency and accuracy is provided and precise, easy changes can be made depending on the size of the garments and the location of the embroidering as needed.

I claim:

1. An embroidery hoop framing jig comprising a hoop framing base, a base insert, said base insert positionable in said hoop framing base, said base insert defining a hoop aperture, said aperture for surrounding an exterior embroidery hoop whereby embroidery material is positioned on said insert over said exterior hoop for accurate hoop framing, a framing base extension, said framing base extension slidably joined to said framing base and including means to secure said framing base extension to said framing base at a selected position, said extension securing means attached to said base.

2. An embroidery hoop framing jig as claimed in claim 1 wherein said hoop framing base defines a depression, said base insert removably positioned in said framing base depression.

3. An embroidery hoop framing jig comprising a hoop framing base, a base insert, said base insert positionable in said hoop framing base, said base insert defining a hoop aperture, said aperture for surrounding an exterior embroidery hoop whereby embroidery material is positioned on said insert over said exterior hoop for accurate hoop framing, and including a framing base top extension and a collar slide, said collar slide movably positioned on said framing base top extension.

4. An embroidery hoop framing jig as claimed in claim 3 wherein said hoop framing base defines a depression, said base insert removably positioned in said framing base depression.

5. An embroidery hoop framing jig comprising a hoop framing base, a base insert, said base insert positionable in said hoop framing base, said base insert defining a hoop aperture, said aperture for surrounding an exterior embroidery hoop whereby embroidery material is positioned on said insert over said exterior hoop for accurate hoop framing, and including a tension member, said tension member affixed to said base insert proximate said aperture to maintain said exterior embroidery hoop in said aperture.

6. An embroidery hoop framing jig as claimed in claim 5 wherein said hoop framing base defines a depression, said base insert removably positioned in said framing base depression.

* * * * *